US009900696B2

(12) United States Patent
Christensen

(10) Patent No.: US 9,900,696 B2
(45) Date of Patent: Feb. 20, 2018

(54) WIDE-RANGE, WIDE-ANGLE LOUDSPEAKER DRIVER

(71) Applicant: Eugene J. Christensen, Aspen, CO (US)

(72) Inventor: Eugene J. Christensen, Aspen, CO (US)

( * ) Notice: Subject to any disclaimer, the term of this patent is extended or adjusted under 35 U.S.C. 154(b) by 5 days.

(21) Appl. No.: 14/748,824

(22) Filed: Jun. 24, 2015

(65) Prior Publication Data

US 2015/0296301 A1 Oct. 15, 2015

Related U.S. Application Data

(63) Continuation of application No. 13/888,836, filed on May 7, 2013, now Pat. No. 9,124,964.

(60) Provisional application No. 61/688,244, filed on May 9, 2012.

(51) Int. Cl.

| | |
|---|---|
| ***H04R 1/02*** | (2006.01) |
| ***H04R 1/00*** | (2006.01) |
| ***H04R 9/06*** | (2006.01) |
| ***H04R 11/02*** | (2006.01) |
| ***H04R 25/00*** | (2006.01) |
| ***H04R 7/12*** | (2006.01) |
| ***H04R 3/00*** | (2006.01) |
| ***H04R 9/04*** | (2006.01) |
| *H04R 1/06* | (2006.01) |
| *H04R 31/00* | (2006.01) |

(52) U.S. Cl.

CPC ..... *H04R 7/122* (2013.01); *H04R 1/025* (2013.01); *H04R 3/00* (2013.01); *H04R 9/046* (2013.01); *H04R 1/06* (2013.01); *H04R 31/00* (2013.01); *H04R 2201/021* (2013.01)

(58) Field of Classification Search

CPC .... H04R 1/025; H04R 2201/021; H04R 1/06; H04R 3/00; H04R 9/046; H04R 31/00; H04R 7/122

USPC ..... 381/395, 186, 398, 399

See application file for complete search history.

(56) References Cited

U.S. PATENT DOCUMENTS

| | | | |
|---|---|---|---|
| 314,155 | A | 3/1885 | Taylor |
| 3,636,278 | A | 1/1972 | Oakar |
| 4,039,044 | A | 8/1977 | Heil |

(Continued)

FOREIGN PATENT DOCUMENTS

| | | | |
|---|---|---|---|
| DE | 102007016582 | B3 | 6/2008 |
| EP | 1646263 | B1 | 7/2010 |

(Continued)

OTHER PUBLICATIONS

European Search Report—European Patent Application No. 13787399.8; dated from European Patent Office—Oct. 1, 2015 Applicant: Eugene J. Christensen.

(Continued)

*Primary Examiner* — Sean H Nguyen

(74) *Attorney, Agent, or Firm* — Sorell Lenna & Schmidt, LLP

(57) ABSTRACT

An air motion transformer loudspeaker driver including a plurality of diaphragm layers having electric conductors. Each of the diaphragm layers defines a surface having at least one curved portion. The curved portions have an axis of curvature being perpendicular to the surface of the diaphragm layer at the location of the curved diaphragm portions.

23 Claims, 24 Drawing Sheets

(56) References Cited

U.S. PATENT DOCUMENTS

| | | | | |
|---|---|---|---|---|
| 4,903,308 | A * | 2/1990 | Paddock | H04R 7/02 181/153 |
| 4,908,601 | A * | 3/1990 | Howze | G08B 3/00 181/144 |
| 5,249,237 | A * | 9/1993 | Paddock | H04R 9/047 381/186 |
| 5,450,497 | A * | 9/1995 | Paddock | H04R 7/12 381/186 |
| 6,061,461 | A * | 5/2000 | Paddock | H04R 9/06 381/186 |
| 2004/0070294 | A1 | 4/2004 | Hanada | |
| 2005/0031153 | A1* | 2/2005 | Nguyen | H04R 9/025 381/414 |
| 2007/0263894 | A1 | 11/2007 | Stiles | |
| 2010/0098271 | A1 | 4/2010 | Mundorf | |
| 2011/0091064 | A1* | 4/2011 | Servadio | H04R 7/20 381/399 |

FOREIGN PATENT DOCUMENTS

| | | |
|---|---|---|
| JP | 5921198 | 2/1984 |
| JP | 09331596 A | 12/1997 |

OTHER PUBLICATIONS

Search Report and Written Opinion of the International Search Authority dated Jun. 7, 2013 of International Application No. PCT/US2013/039910 filed May 7, 2013.

PCT International Preliminary Report on Patentability from the International Bureau of WIPO dated Nov. 11, 2014, of International Application No. PCT/US2013/039910 filed May 7, 2013.

International Search Report and Written Opinion of the International Searching Authority dated Sep. 24, 2013 from the Korean Intellectual Property Office in corresponding PCT Application—PCT/US2013/039910.

* cited by examiner

WIDE-RANGE, WIDE-ANGLE LOUDSPEAKER DRIVER

RELATED APPLICATION

This application is a continuation of U.S. patent application Ser. No. 13/888,836, filed on May 7, 2013, which claims priority to U.S. Provisional Application Ser. No. 61/688,244 filed on May 9, 2012. These applications are incorporated herein by reference, in their entireties.

TECHNICAL FIELD

The present invention relates generally to loudspeaker drivers, and more particularly to loudspeaker drivers of the air motion transformer type, also generally known to those skilled in the art as "AMT" loudspeaker drivers.

BACKGROUND

In U.S. Pat. No. 3,636,278 inventor Oskar Heil described a number of embodiments of AMT loudspeaker drivers, in which audible sound is produced through the immersion of a thin, flexible, folded diaphragm into a magnetic field, in such a way that when alternating audio-frequency electric current flows through conductors etched onto the folded diaphragm, the adjacent portions of the folded diaphragm will either move away from each other, or toward each other, depending on the relative direction of electric current flow in each diaphragm moving section.

This movement of the diaphragm sections results from the Lorentz Force, generally known to those skilled in the art, which is caused by the interaction between the applied magnetic field and the electric current flow in the diaphragm conductors, thus producing an alternating increase or decrease in air pressure in the semi-confined air spaces between the diaphragm layers, which causes sound waves to emanate from the front and rear openings of the semi-confined air spaces which are bound by the adjacent diaphragm portions, the folds between the diaphragm portions, and the various air-sealing surfaces located near the ends of the adjacent diaphragm portions.

In related art, the aforementioned rectangular folded diaphragm, with its attached electrical conductors, is typically produced by using a photo-chemical process to etch an electrical signal path into an aluminum foil layer which has been laminated onto a very thin, rectangular plastic sheet, such as that shown in FIG. 1A of U.S. Pat. No. 3,832,499.

This rectangular sheet, with its attached and straight, photo-etched conductors, in related art, is then folded into a narrow, rectangular, accordion bellows-like shape, thus producing a plurality of long, narrow, semi-confined air spaces located between the moving, adjacent portions of the folded diaphragm.

The resulting relatively long, straight, narrow folded diaphragm, after being placed in the appropriate magnetic field of a completed loudspeaker driver, is then typically mounted into a loudspeaker, with the longer dimension running in the vertical direction, and the shorter dimension running in the horizontal direction. The resulting long, narrow, straight, folded diaphragm shape, in related art, has a number of substantial and heretofore unavoidable drawbacks, including extremely limited vertical dispersion at the higher audio frequencies, especially above 2 Kilohertz, and a practical limit on the maximum length of the longer dimension of the folded diaphragm, which is typically not much longer than eight inches or so due to the handling problems caused by the use of extremely thin diaphragm material, which is typically only about $1/1000^{th}$ of an inch thick.

The resulting limitation on the maximum practical length of the long, straight, rectangular folded diaphragm, in related art, also limits the amount of total effective moving surface area available, which in turn limits both the low frequency cut-off of the device to about 800 Hertz, and also limits the maximum power handling capacity of the device because of the limited heat dissipation capability of the relatively small electrical conductor total surface area.

The folded diaphragm, in related art, is typically limited in its narrower, horizontal dimension, to about one inch or less, to allow for high-frequency dispersion to exist in the horizontal direction, which is generally about plus-or-minus sixty degrees or less at the higher audio frequencies.

In the related art of U.S. Pat. No. 3,636,278 FIG. 12a and FIG. 12b, inventor Oskar Heil described a type of AMT diaphragm configuration in which the angle of the folds between adjacent folded diaphragm sections is varied between the inner and outer folds, which allows for the overall folded diaphragm shape to follow a varying path, even though each individual moving section of diaphragm and conductor only follows a straight path. The resulting overall diaphragm shape, however, has the substantial disadvantage of having adjacent sections of moving diaphragm area which are not always generally parallel to each other, and which vary in their geometry between the inner and outer semi-confined airspaces, which causes substantial audio distortion due to non-linearities in the non-optimally acoustically loaded inner versus outer moving diaphragm surfaces.

The resulting moving diaphragm sections of the related art as shown by FIG. 12a and FIG. 12b of U.S. Pat. No. 3,636,278 are also quite small in their individual effective moving areas, the sum total of which typically comprises much less than one-fourth of the total surface area of the etched diaphragm sheet before being folded.

SUMMARY

Accordingly, an air motion transformer loudspeaker driver is provided. In accordance with the principles of the present disclosure the air motion transformer loudspeaker driver includes a plurality of diaphragm layers having electric conductors. Each of the diaphragm layers defines a surface having at least one curved portion. Each such curved portion has a corresponding axis of curvature being generally perpendicular to the surface of the diaphragm layer at the location of the curved diaphragm portion, or curved electric conductor portion, or curved diaphragm edge portion. A "perpendicular axis of curvature" to curved lines on a surface, in this case, is defined as an axial line drawn along a vector which is considered mathematically "normal" to, or generally perpendicular to, said lines on a surface at the point or points of said curvature, as conceptually shown in FIG. 5B.

The present invention solves the numerous problems, of related art, which include limited vertical and horizontal dispersion, limited low-frequency cut-off, and limited maximum power handling capacity, through the introduction of a novel and extremely effective curved diaphragm geometry, which allows for several substantial improvements, such as unlimited horizontal dispersion of sound, which is uniform at up to 360 degrees at all audio frequencies, and allows for greatly improved vertical dispersion at high audio frequencies, and which also allows for a much deeper low frequency cut-off, which can be several octaves lower than that in related art, and also allows for much higher maximum power handling capacity, which can be several times higher than the power handling capacity in related art.

Unlike related art, in which the diaphragms with electric conductors are created using straight-line configurations, which are then folded into a rectangular, straight, accordion bellows-like shape, the present invention constructs the diaphragm layers and attached electric conductors in a novel, curved configuration, with the axis of curvature being perpendicular to the surfaces of the diaphragm layers at the point or points of curvature. The curved diaphragm layers can then either be stacked or folded over each other to form a diaphragm stack, utilizing curved inner and outer support/sealing members and small pieces of alignment material placed between adjacent diaphragm layers, which allows for proper spacing and partial sealing between each diaphragm layer, and also allows for each diaphragm layer and conductor to follow a non-straight path, which can be a circle, any other closed-loop path such as an oval, etc., or any arbitrary arc-shaped segment, or any other generally non-straight overall path.

In addition to solving the numerous problems associated with the typically long, straight, folded rectangular diaphragm shapes as utilized in related art, the novel, curved construction of the present invention also avoids the problems associated with the diaphragm configuration as shown in other related art such as that illustrated by FIG. 12a and FIG. 12b of U.S. Pat. No. 3,636,278.

In the present invention, the resulting curved diaphragms and conductors may be built in nearly any overall size or shape desired, up to several feet or more in overall width, which eliminates the aforementioned maximum practical length limitation exhibited by the related art which generally suffers from severe "beaming" of the high audio frequencies in the vertical direction.

In the present invention, the curved diaphragm layer construction may also be customized to appropriately cover nearly any audio frequency sub-range desired, without any negative consequences in horizontal or vertical sound dispersion, power handling capacity or low frequency cut-off limits.

As an added benefit, the present invention, in addition to utilizing thin, flexible sheets for the diaphragm layers, may also be constructed using rigid or semi-rigid moving sections of diaphragm layers, due to its novel construction methods, with each of said moving diaphragm section able to be completely surrounded by compliant structures to allow for substantial and nearly "pistonic" diaphragm section movement.

DETAILED DESCRIPTION OF THE INVENTION

Figure 1A:
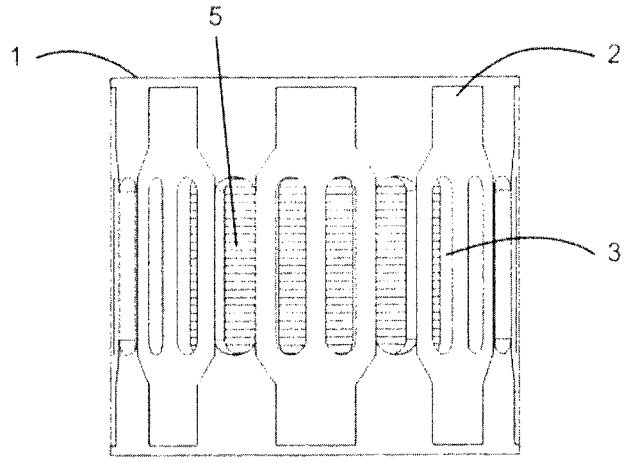
FIG. 1A is an external side-view of the preferred embodiment of the device.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure. Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following disclosure includes a description of a loudspeaker driver device which can be used to produce wide-range, wide-angle, high-quality audible sound, of the type generally known to those skilled in the art as an "Air Motion Transformer", or "AMT" type of device. The disclosure also includes a description of related methods of employing the disclosed loudspeaker device. Alternate embodiments are also disclosed. Reference will now be made in detail to the exemplary embodiments of the present disclosure, which are illustrated in the accompanying figures. Turning now to FIGS. 1-24, there are illustrated components of a loudspeaker device and embodiments in accordance with the principles of the present disclosure.

The present invention relates to a loudspeaker driver device which can be used to produce wide-range, wide-angle, high-quality audible sound, of the type generally known to those skilled in the art as an "Air Motion Transformer", or "AMT" type of device, in which an alternating electrical audio signal is sent to a number of generally parallel diaphragm surfaces, with semi-confined air spaces located between the diaphragm surfaces, said airspaces being open at alternating inner and outer edges between the adjacent diaphragm layers.

The adjacent diaphragm portions have conductors on their surfaces, or embedded in or under their surfaces, or the diaphragm layers can themselves be made of electrically conductive materials.

A magnetic field originates from permanent magnets, or electro-magnets, which are arranged to produce an appropriate magnetic field in the area in which the diaphragm moving surfaces are located, in such a way that the magnetic field flux lines intersect the current flow of the diaphragm conductors at essentially right angles, causing adjacent diaphragm layers to move toward each other, or away from each other, due to the Lorentz Force exerted on the electrons moving in the conductors, depending on the direction of current flow for each diaphragm layer.

A positive signal voltage applied to the electric leads of the device causes air to move radially outward from the front, or outer, surface of the device, while an applied negative signal voltage causes air to move radially inward toward the rear, or center, of the device. The front or rear, or outer or inner, sound-producing areas of the device may be sealed, stuffed, ported, horn-loaded or otherwise vented, or completely or partially sealed.

In such a way, a very high-quality loudspeaker driver can be achieved in the present invention, exhibiting an extremely wide frequency range, extremely wide vertical and horizontal dispersion angles, and high efficiency, using very simple construction methods and at reasonable manufacturing costs.

Figure 1B:
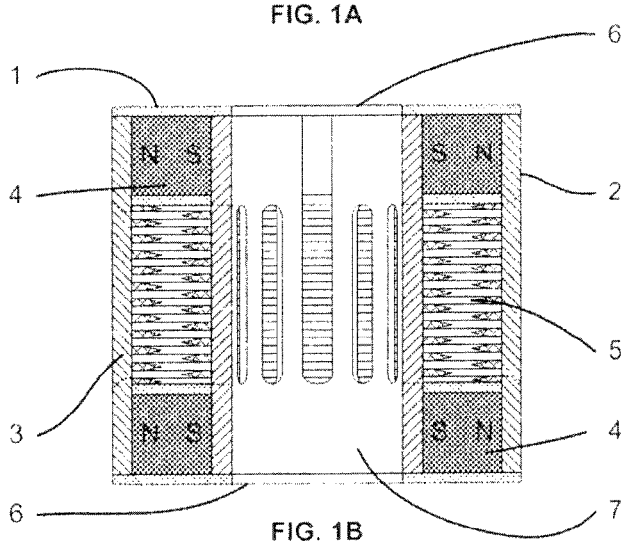
FIG. 1B shows a cross-section of the device of FIG. 1A, taken along the view line as shown in FIG. 1C.
Figure 1C:
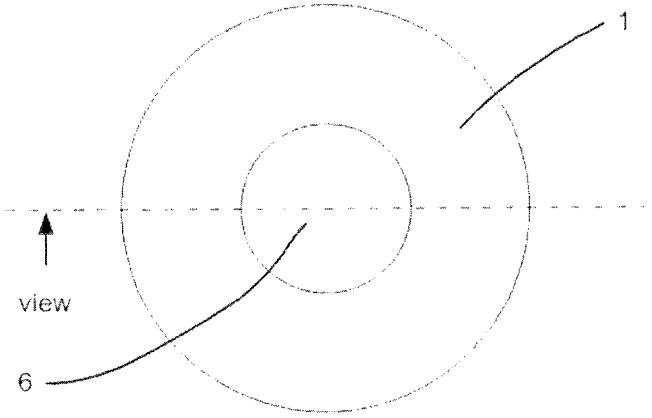
FIG. 1C shows a top-view of the device of FIG. 1A.
Figure 5A:
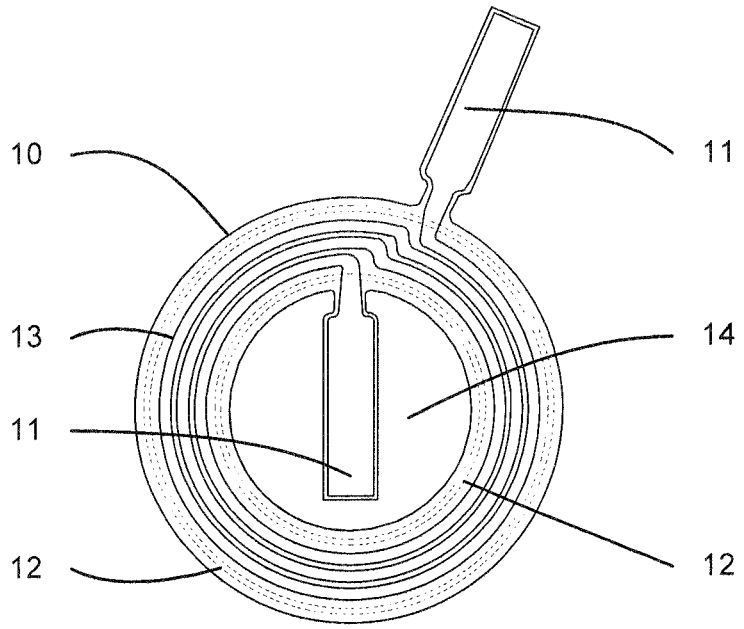
FIG. 5A shows the top-view of one pre-assembly diaphragm layer of the diaphragm stack as shown in FIG. 1B, also showing the optional pleated areas using dotted lines.
Figure 5B:
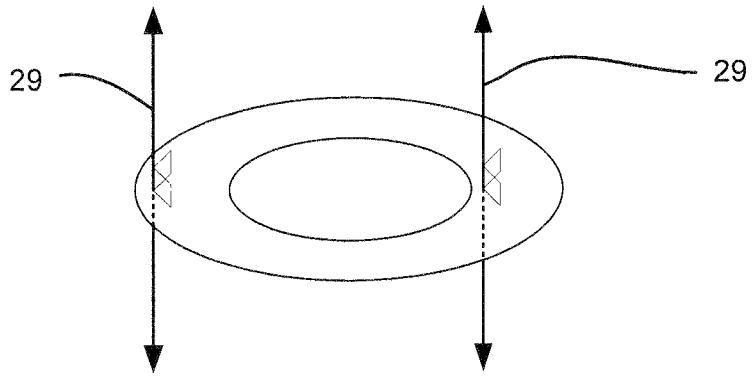
FIG. 5B shows a conceptual, perspective view of an "axis of curvature" being generally perpendicular to curved lines on the surface or edge of a diaphragm layer as shown on FIG. 5A.
Figure 6:
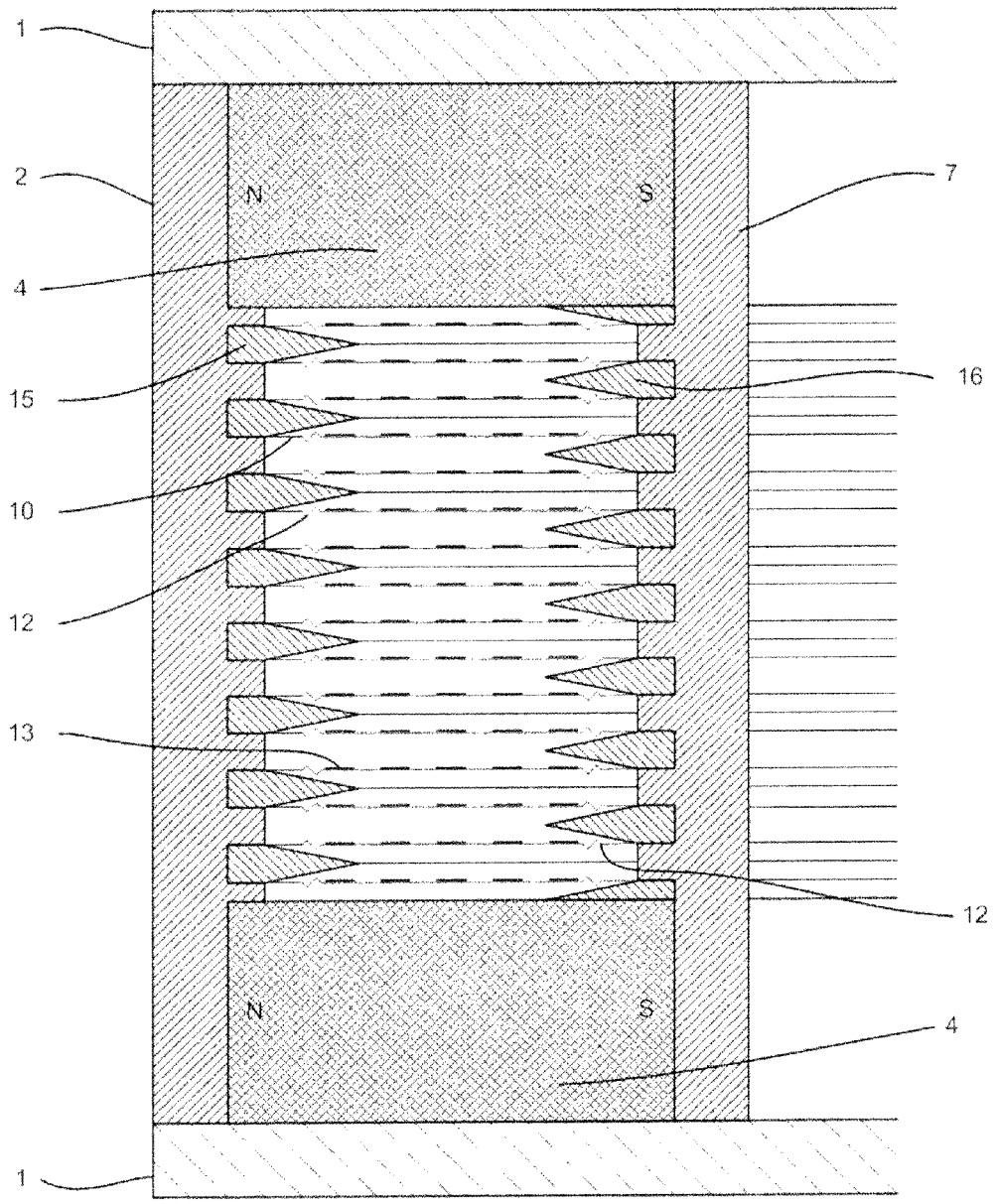
FIG. 6 shows a vertical cross-section of an alternative embodiment of the device.
Figure 7A:
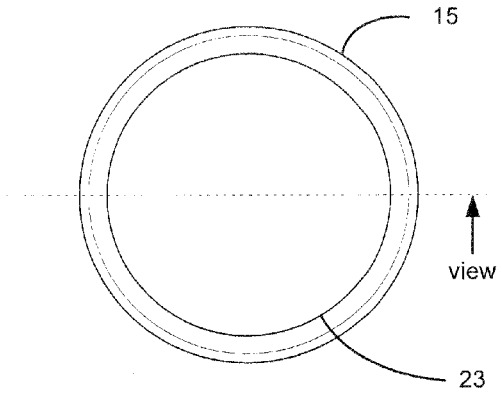
FIGS. 7A and 7B show the outer support/sealing rings of the diaphragm stack of the device as shown in FIG. 1B.
Figure 7C:
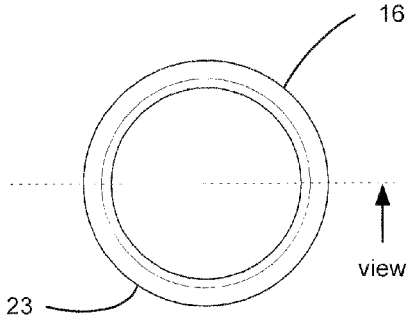
FIGS. 7C and 7D show the inner support/sealing rings of the diaphragm stack of the device as shown in FIG. 1B.
Figure 7B:
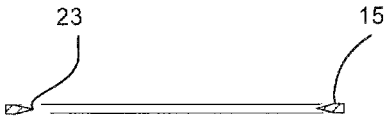
Figure 7D:
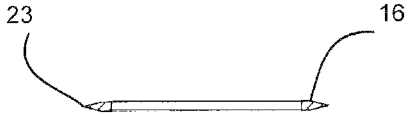
Figure 8:
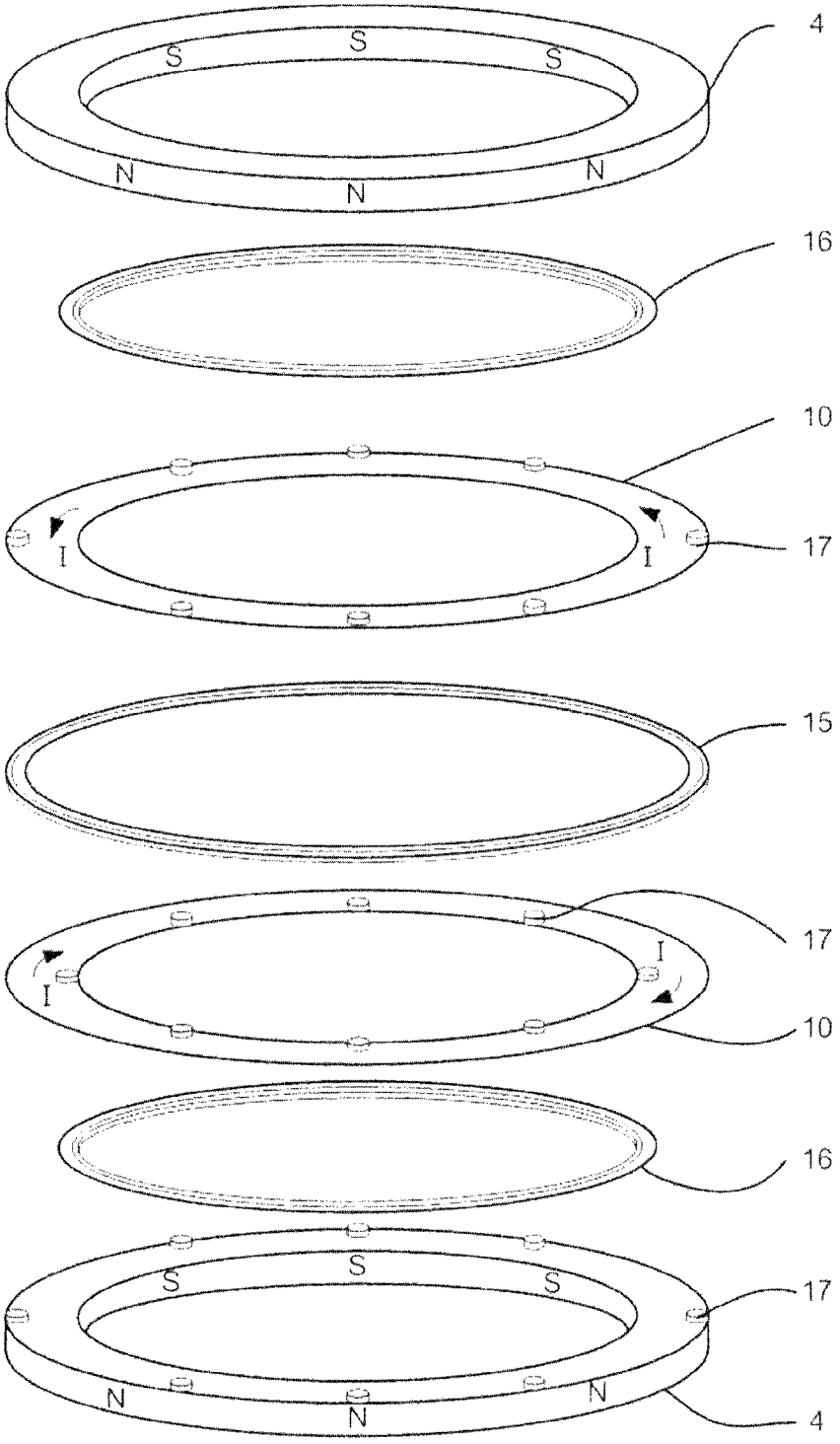
FIG. 8 shows an exploded, conceptual view of the present invention, exhibiting radially-charged magnetic rings.
Figure 11A:
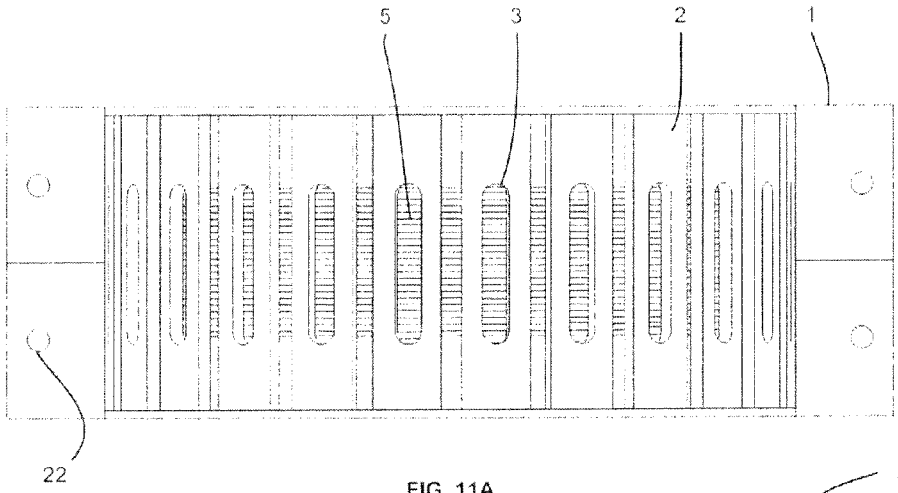
FIG. 11A shows the external front-view of a semi-circular embodiment of the device.

In the present invention, the generally curved diaphragm layers 10 of the preferred 360-degree embodiment as shown in FIGS. 1A-C, and as also shown in the alternative embodiment of the 180-degree version of FIGS. 11A&B, with an axis of curvature 29 as conceptually shown in FIG. 5B, are arranged in a plurality of generally parallel layers 10, including the semi-confined airspaces bound between each diaphragm layer 10, with each diaphragm layer having a current flow direction which is generally perpendicular to the radial magnetic field direction, and opposite to that of the layers adjacent to it, as shown by the curved arrows marked with the letter "I" in the exploded, conceptual view of FIG. 8. The structure of diaphragm layers 10 may range from 1 degree to 360 degrees.

The width of each diaphragm layer 10 across one set of electric conductors 13 is typically about one-half inch, but can be greater or lesser to accommodate various audio frequency sub-ranges. The thickness of the diaphragm substrate is typically about $1/1000^{th}$ of an inch or less. The thickness of the typically aluminum electrical conductor traces 13 is typically about $1/1000^{th}$ of an inch or less. It is contemplated that aluminum electrical conductor traces 13 can be of varied thickness depending on a particular application.

As shown in FIGS. 1A-C, and conceptually illustrated in the exploded view of FIG. 8, the preferred embodiment may be assembled by combining the required individual components including the magnets 4, the magnet support structures 1, the inner sealing/support rings 16, the outer sealing/support rings 15, the diaphragm layers 10, the small pieces of alignment material 17, the inner pole pieces 7 and the outer pole pieces 2 as shown in FIG. 1B, using adhesives, screws, magnetic attraction or by any other suitable means generally known to those skilled in the art. An alternative embodiment of the device may also be assembled as shown in FIG. 23.

Figure 9A:
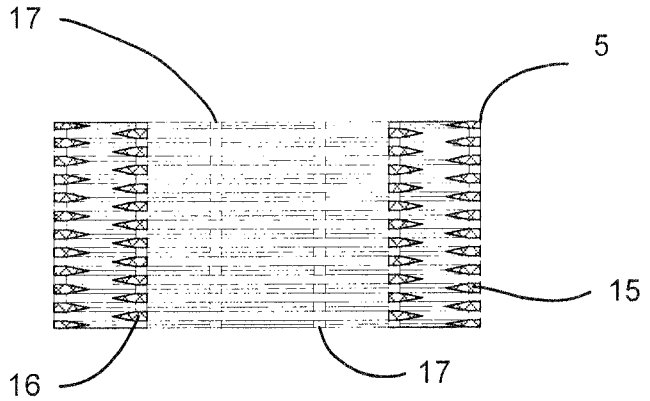
FIG. 9A shows the external side-view of the diaphragm stack of the device shown in FIG. 1A.
Figure 9B:
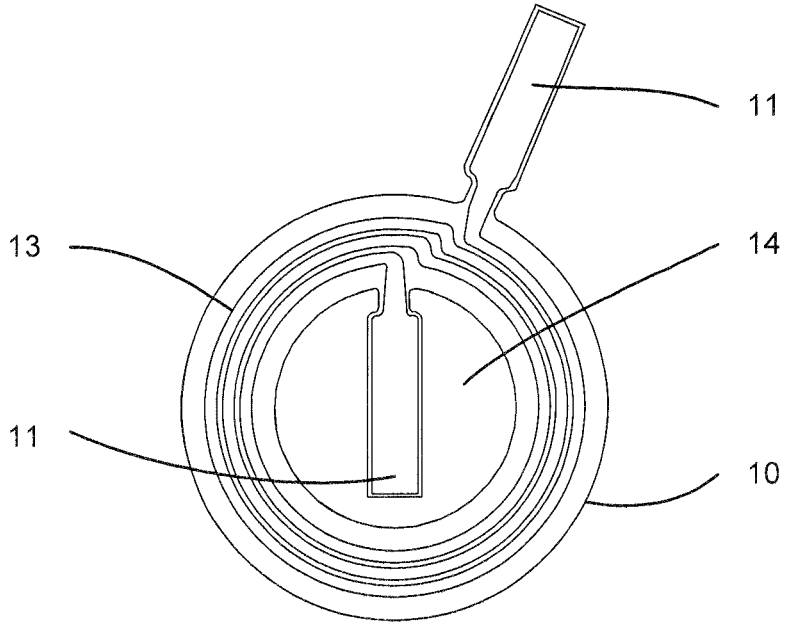
FIG. 9B shows a top-view of a single pre-assembly diaphragm layer of the present invention as shown in FIG. 1A.
Figure 20A:
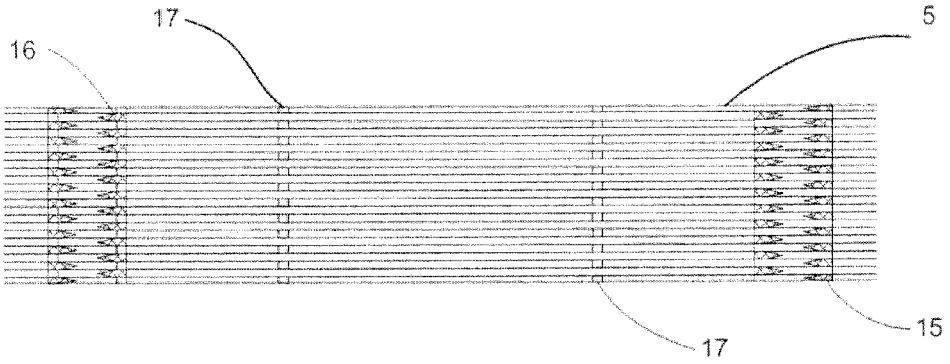
FIG. 20A shows the external front-view of the diaphragm stack of the device shown in FIG. 11A.
Figure 23:
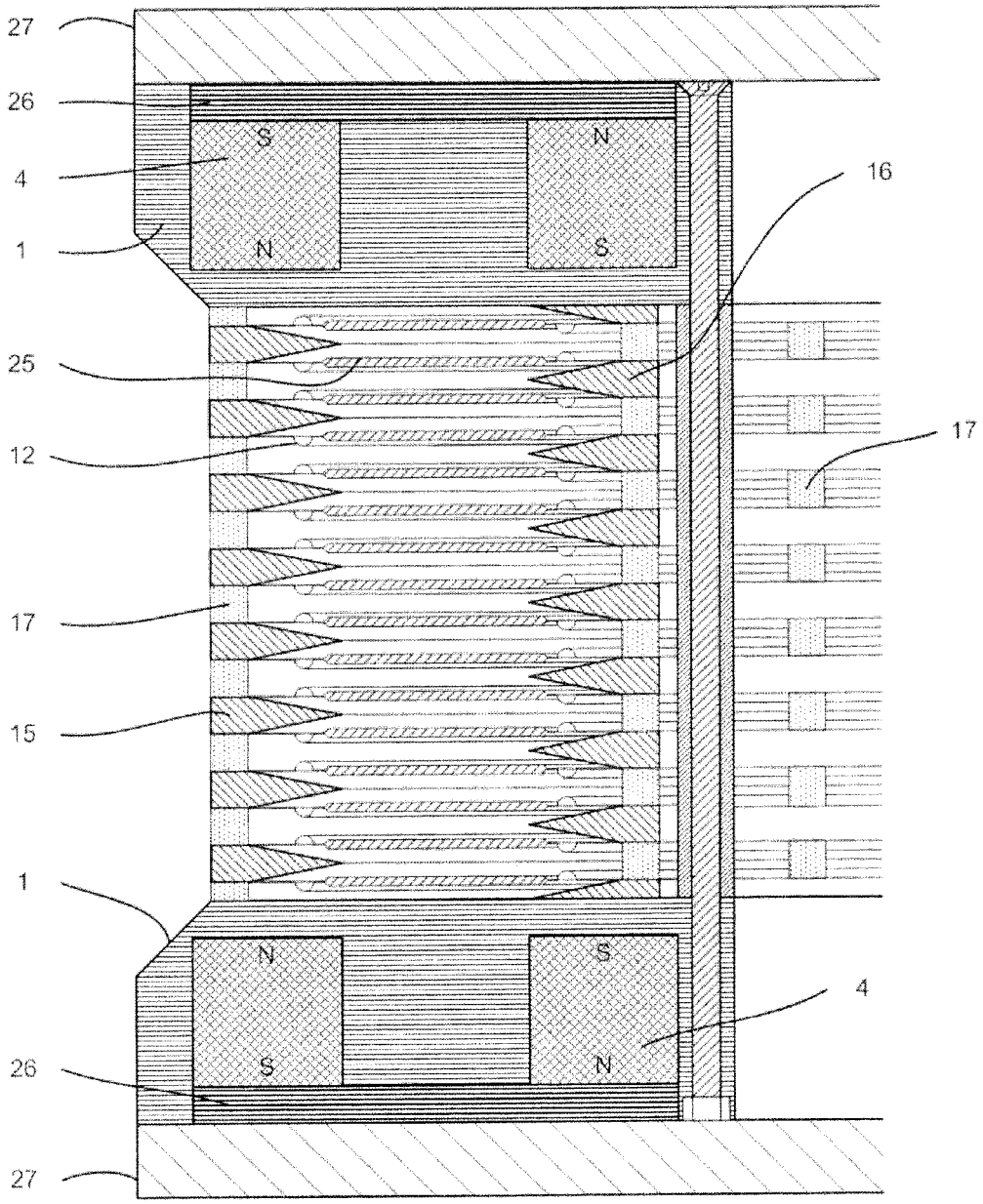
FIG. 23 shows a vertical cross-section of an alternative embodiment of the present invention, using rigid or semi-rigid sections of diaphragm layers with flexible surround elements, and using an alternative magnet support structure.

A user-replaceable diaphragm stack 5 can be first and separately be constructed, as shown in the 360-degree, preferred embodiment of FIG. 9A, and in the alternative 180-degree embodiment of FIG. 20A, and in the conceptual exploded view of FIG. 8, and in the alternative embodiment as shown in FIG. 23, by placing an inner support/sealing ring 16 along with spaced, small pieces of alignment material 17 near the diaphragm layer edge opposite from the inner support/sealing ring 16 in a semi-confined air space between adjacent diaphragm layers, and then placing an outer support/sealing ring 15 along with spaced, small pieces of alignment material 17 near the diaphragm layer edge opposite from the outer support/sealing ring 15 in the semi-confined airspace between the subsequent adjacent diaphragm layer, and so on, until the desired number of layers has been built up, typically to about a total of twenty-four diaphragm layers or so, keeping the overall diaphragm stack 5 height to typically around one inch or less.

The overall width of the diaphragm stack 5 can be designed to be of nearly any size desired, and it can be made larger or smaller in overall width or height to accommodate various audio frequency ranges. As shown in FIG. 5, electrical connections can be made at connection points 11 for each diaphragm layer, taking care to ensure that current flows in opposite directions for adjacent diaphragm layers, as shown by the curved arrows in the exploded view of FIG. 8.

Figure 10:
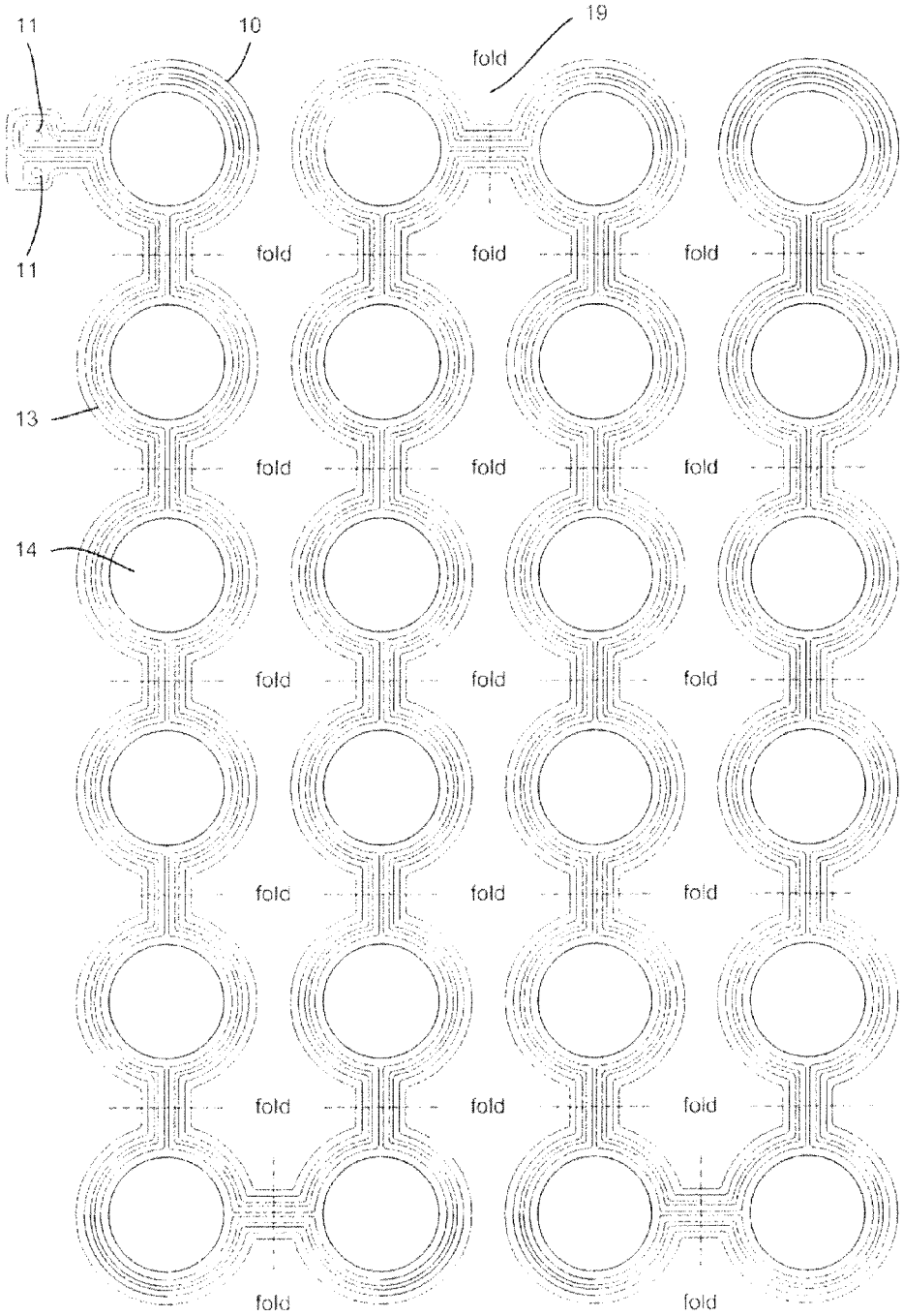
FIG. 10 shows one possible pre-assembly layout of a 24-layer diaphragm stack for a circular-loop embodiment of the device.

Alternatively, electrical connections between diaphragm layers can also consist of simple folds made between continuous diaphragm layers which have been constructed from a single sheet of laminated and subsequently photo-etched diaphragm/conductor material, as shown in FIG. 10.

Figure 18A:
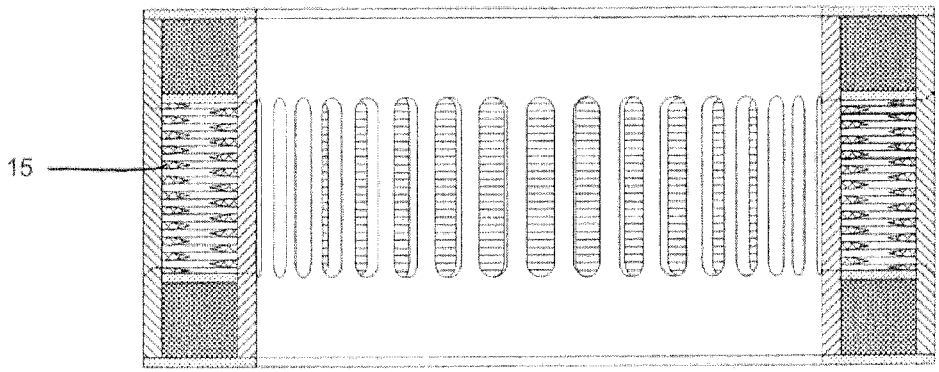
FIG. 18A shows the vertical rear cross-section of FIG. 13A, with the view line as shown in FIG. 13B.
Figure 18B:
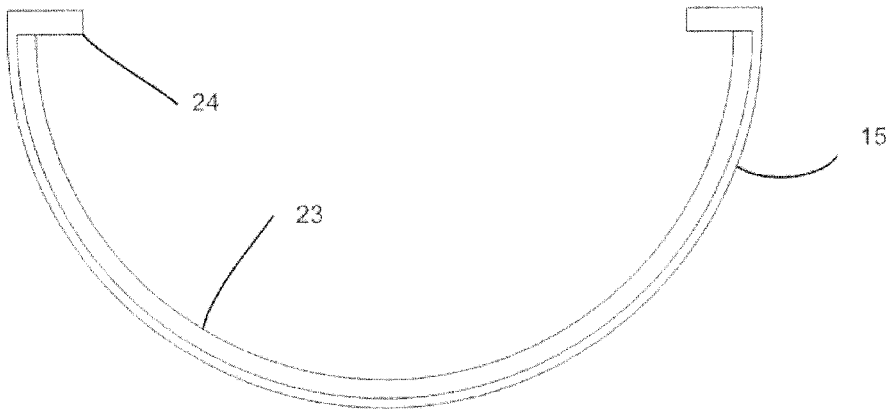
FIG. 18B shows the external top-view of the outer support/sealing members of the diaphragm stack as shown in FIG. 20A.
Figure 19A:
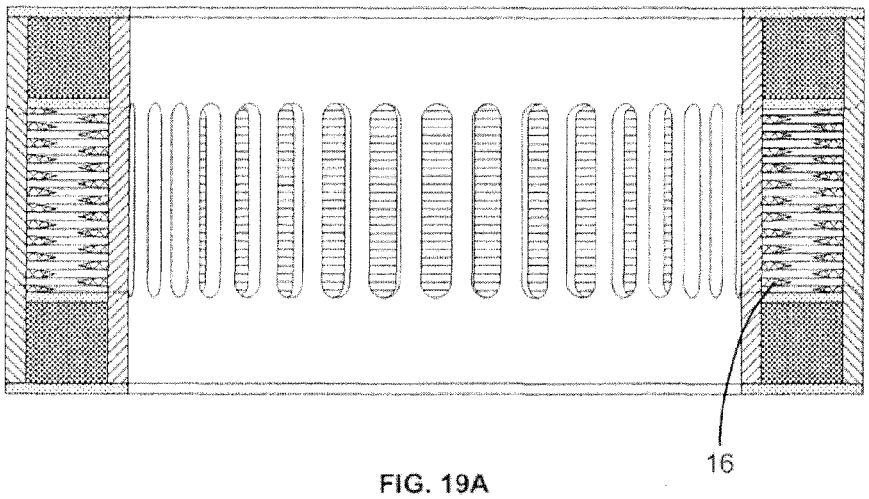
FIG. 19A shows the vertical rear cross-section of FIG. 13A, with the view line as shown in FIG. 13B.
Figure 19B:
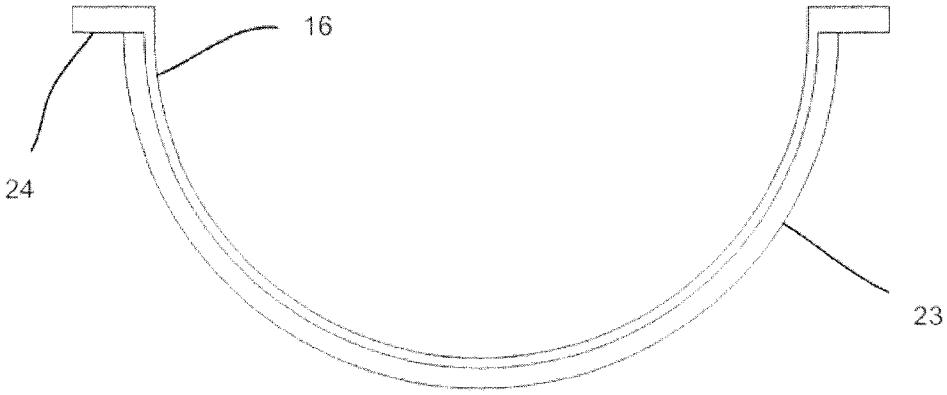
FIG. 19B shows the external top-view of the inner support/sealing members of the diaphragm stack as shown in FIG. 20A.

As shown in FIGS. 7A-D, and in the alternative embodiments of FIG. 18B and FIG. 19B, the inner and outer sealing/support rings 16 and 15 respectively can be made from a wide variety of suitable materials, such as 3-D printed or injection molded thermoplastic.

The inner and outer sealing/support rings 16 and 15 each may include cone-shaped cross-section elements 23, the purpose of which are to minimize any acoustic standing waves that might otherwise exist inside the semi-confined air spaces between each diaphragm layer 10.

Figure 13A:
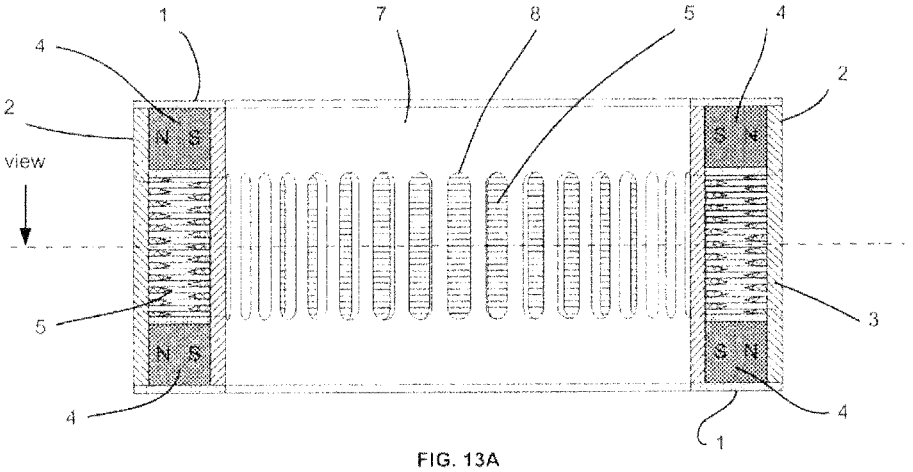
FIG. 13A shows a rear-view cross-section of the device of FIG. 12A, with the view line as shown in FIG. 13B.
Figure 13B:
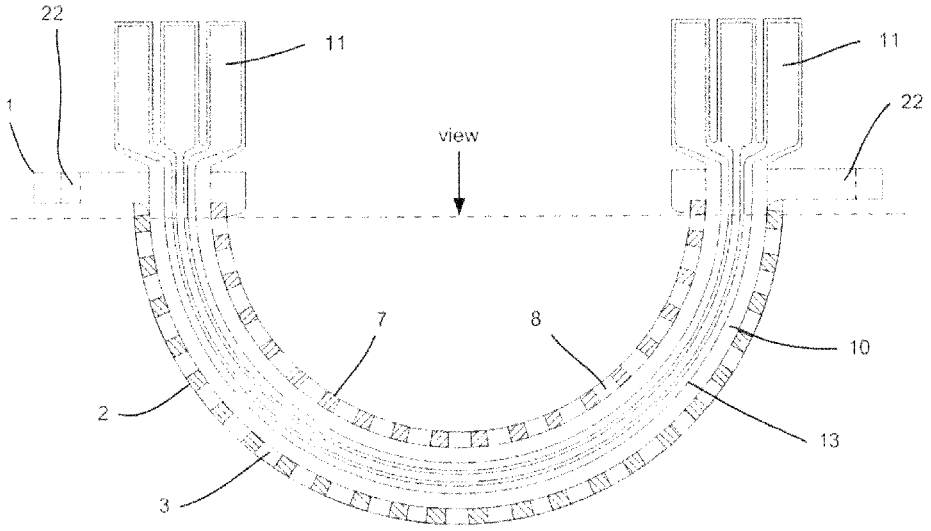
FIG. 13B shows a top-view cross-section of the device of FIG. 12A, with the view line as shown in FIG. 13A.

The inner and outer support/sealing rings 16 and 15 of the alternative 180-degree embodiments of FIG. 18B and FIG. 19B may also include generally short, flat extensions 24 which seal the air spaces near the ends of the diaphragms in the arc-shaped embodiments as shown in FIGS. 13A&B.

Figure 2A:
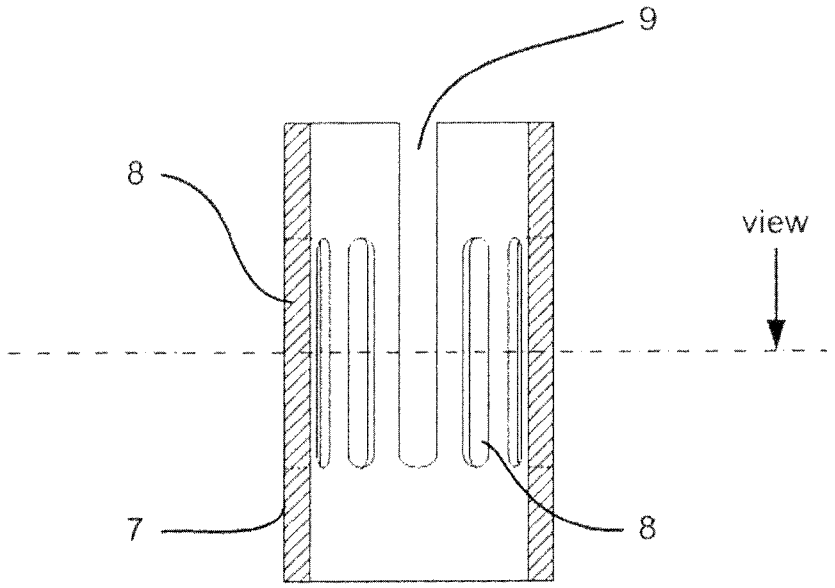
FIG. 2A shows a vertical cross-section of the inner pole piece of the device of FIG. 1A, taken along the view line shown in FIG. 2B.
Figure 2B:
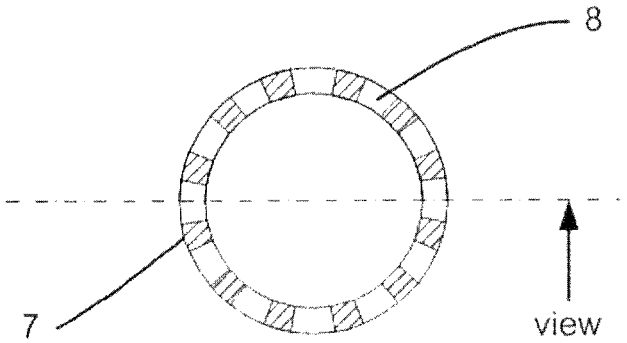
FIG. 2B shows a vertical cross-section of the inner pole piece of the device of FIG. 1A, taken along the view line shown in FIG. 2A.
Figure 4A:
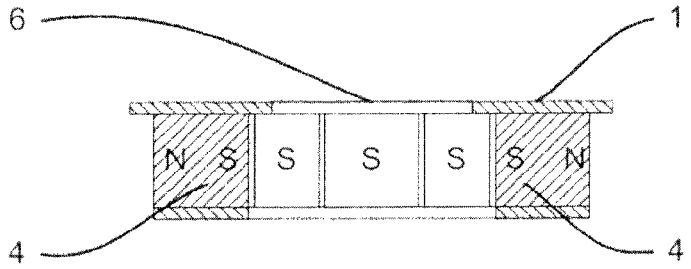
FIG. 4A shows a vertical cross-section of the upper magnet support structure and magnets of the device shown in FIG. 1A, taken along the view line as shown in FIG. 4C.
Figure 4B:
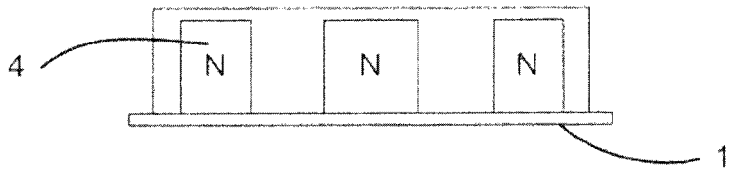
FIG. 4B is an external side-view of the upper magnet support structure and magnets of the device shown in FIG. 1A.
Figure 4C:
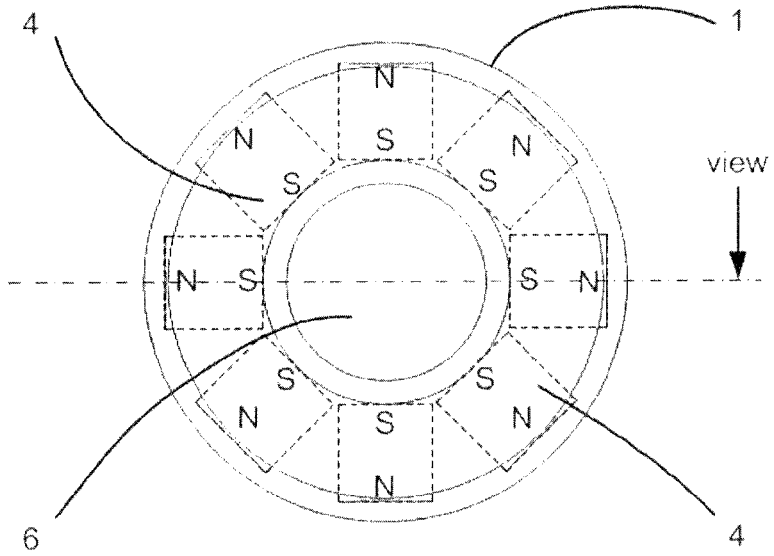
FIG. 4C shows a top-view of the lower magnet support structure as shown in FIG. 4B, with the location of the internal magnets as shown by the dotted lines.

The completed diaphragm stack 5 of FIG. 9A, is a self-supporting structure which can then be placed in the magnetic field of the preferred embodiment of FIG. 1A by first inserting the lower end of the inner pole piece 7 shown in FIG. 2A into the center hole in the lower magnet support structure 1 shown in FIG. 4B, then inserting the magnets 4 into the holes in the lower magnet support structure 1 as shown in FIG. 4B, allowing the south poles of the magnets to be attracted toward the center pole piece 7, and taking care to align the north and south poles of the magnets 4 as shown in FIGS. 4B&C.

The completed diaphragm stack 5 can then be slid down over the inner pole piece 7, taking care to align any inner diaphragm leads 11 with the slot 9 in the inner pole piece 7. The upper magnet support structure 1 shown in FIG. 4A can then be slid down over the inner pole piece 7, using the smooth, flat, upper surface of FIG. 4B and the smooth, flat, lower surface of FIG. 4A to form an air-tight seal between the inner and outer surfaces of the diaphragm stack 5.

Magnets 4 can then be inserted into the holes in the upper magnet support structure 1 shown in FIG. 4A, allowing the south poles of the magnets to be attracted toward the inner pole piece 7, and taking care to align the north and south poles of the magnets 4 as shown in FIG. 4A. Alternatively, the magnets 4 may also be magnetized after being inserted into the magnet support structures 1.

Figure 3A:
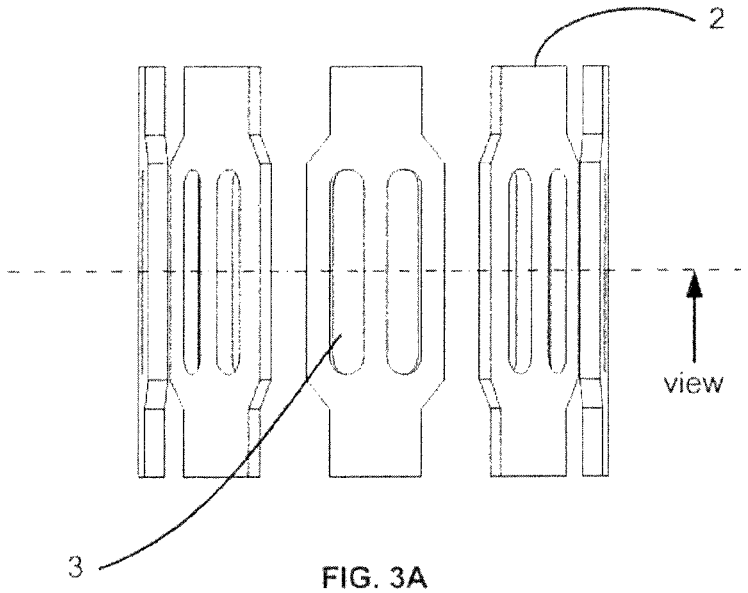
FIG. 3A is an external side-view of the outer pole pieces of the device of FIG. 1A.
Figure 3B:
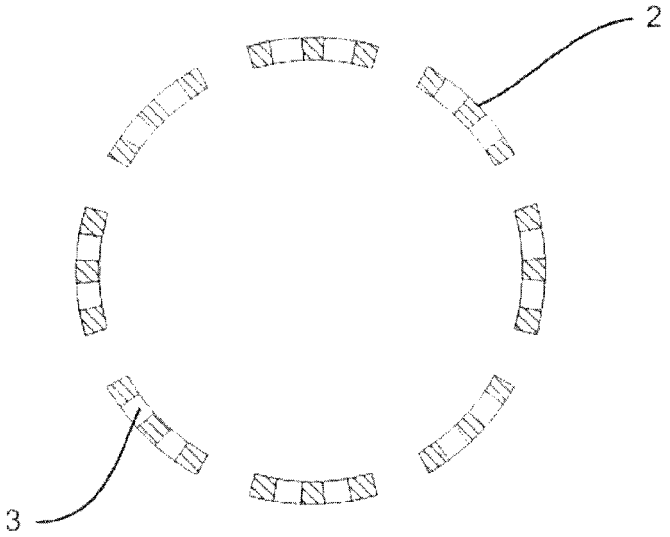
FIG. 3B shows a vertical cross-section of the outer pole pieces shown in FIG. 3A, taken along the view line shown in FIG. 3A.

The outer pole pieces 2 shown in FIGS. 3A&B can then be placed onto the exposed north poles of the magnets 4 of both the upper and lower magnet support structures 1 shown in FIGS. 1A&B, using magnetic attraction to keep the outer pole pieces 2 in place, as well as using any appropriate additional fixing means, generally known to those skilled in the art, that might be necessary.

As shown in FIG. 1C, the upper and lower surfaces of the magnet support structures 1 of the assembled preferred embodiment shown in FIG. 1A can be left open, sealed, ported, dampened, horn-loaded or otherwise vented by any suitable means, such as by a simple plate 26 as shown in the alternative embodiment of FIG. 23, or by any other desired combination of ports, vents, horn flares, surfaces or other wave-guiding, sealing or dampening materials, etc., generally known to those skilled in the art.

The construction method for the alternative, 180-degree embodiment as shown in FIGS. 11A&B is very similar to the above construction method for the preferred embodiment of FIG. 1A.

Figure 20B:
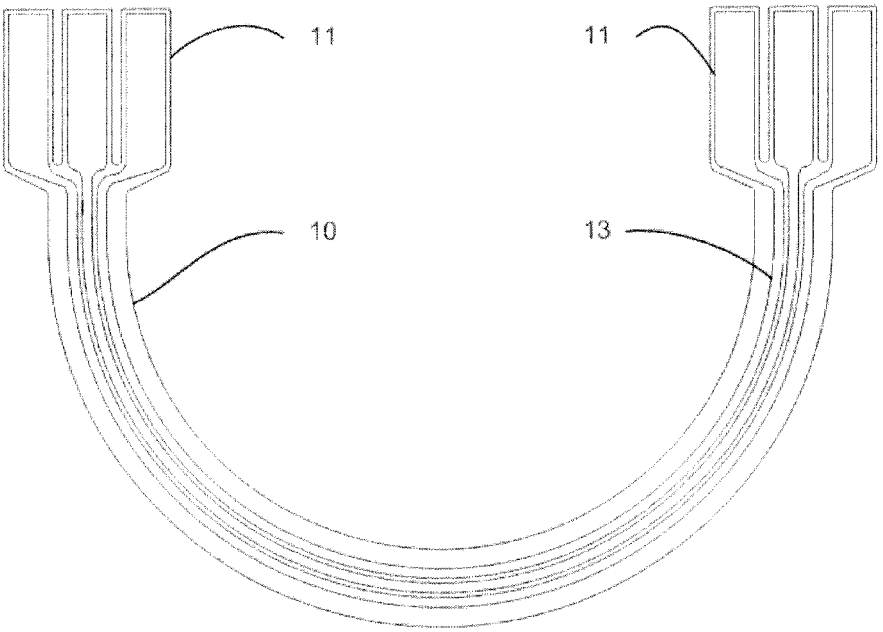
FIG. 20B shows the top-view of one pre-assembly diaphragm layer of the diaphragm stack as shown in FIG. 20A.
Figure 21:
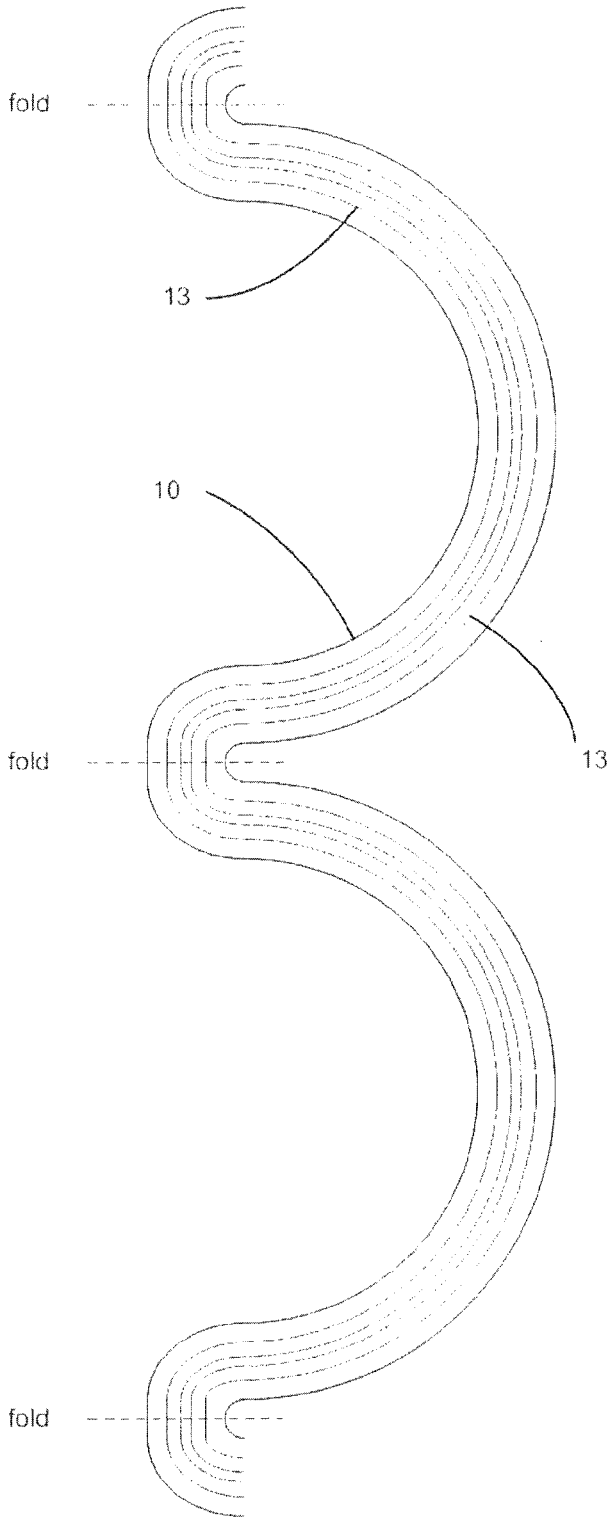
FIG. 21 shows one possible pre-assembly layout of a section of a diaphragm stack for a semi-circular embodiment of the device.

The alternative, 180-degree embodiment of FIG. 11A can be assembled by first and separately constructing the diaphragm stack 5 of FIG. 20A, either through the stacking of individual diaphragm layers 10 of FIG. 20B, or through the alternative method of diaphragm stack folding shown in FIG. 21.

Figure 12A:
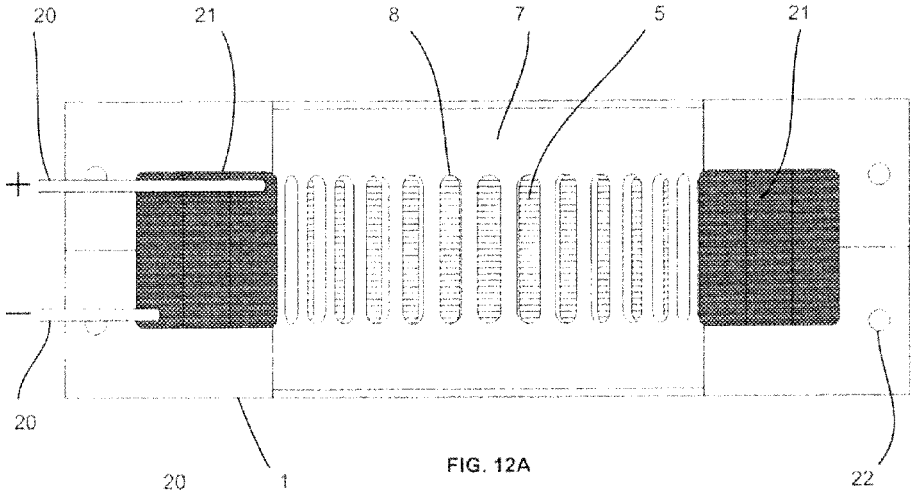
FIG. 12A shows the external rear-view of a semi-circular embodiment of the device.
Figure 14A:
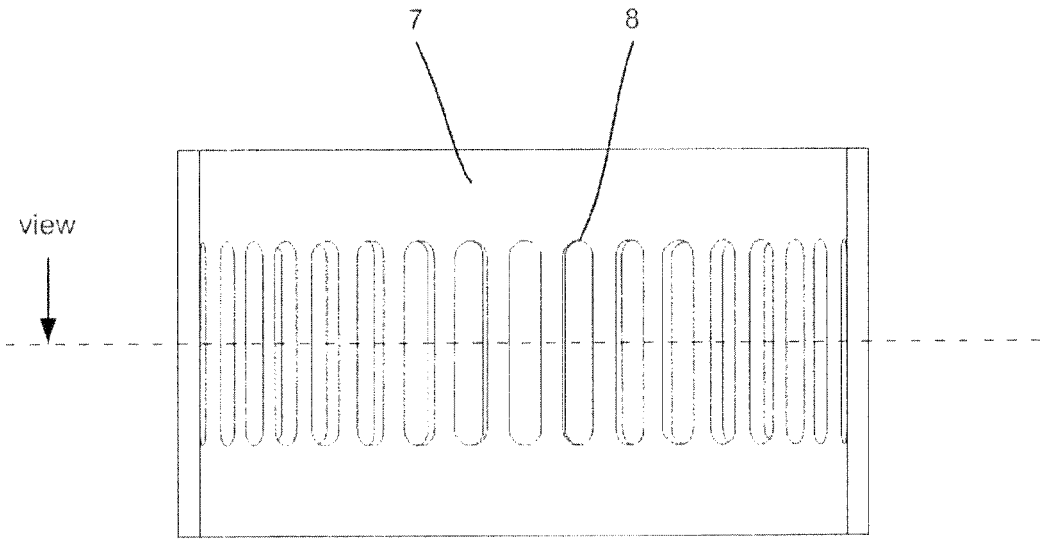
FIG. 14A shows the external rear view of the inner pole piece of the device of FIG. 12A.
Figure 16A:
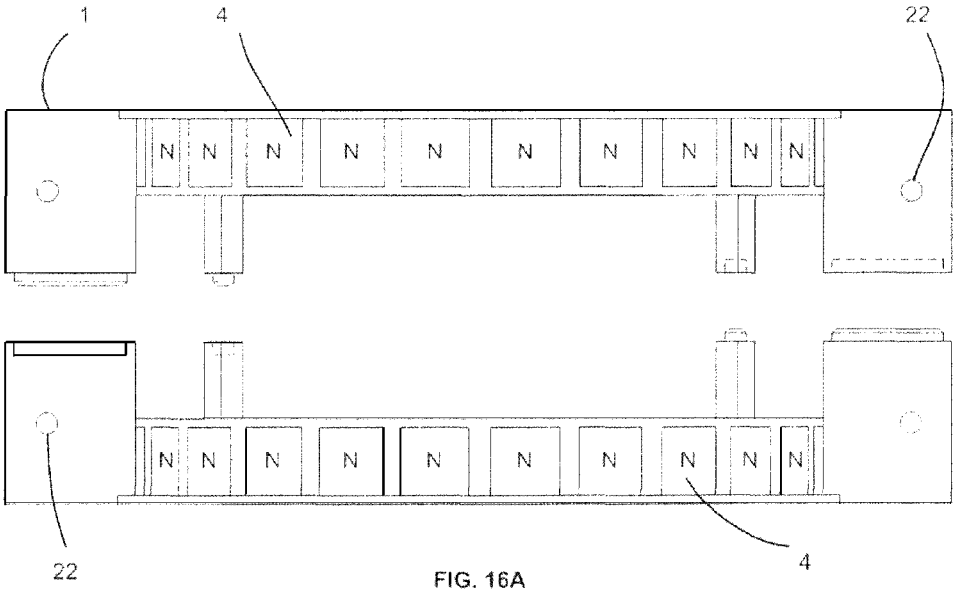
FIG. 16A shows the front external view of the upper and lower magnet support structures and magnets of the device of FIG. 12A.
Figure 16B:
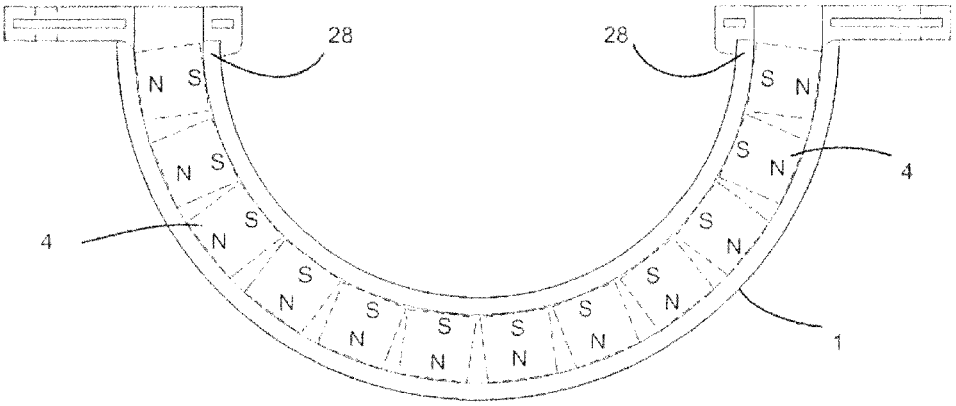
FIG. 16B shows the top-view of the lower support structure of FIG. 16A, with the location of the internal magnets as shown by the dotted lines.
Figure 17A:
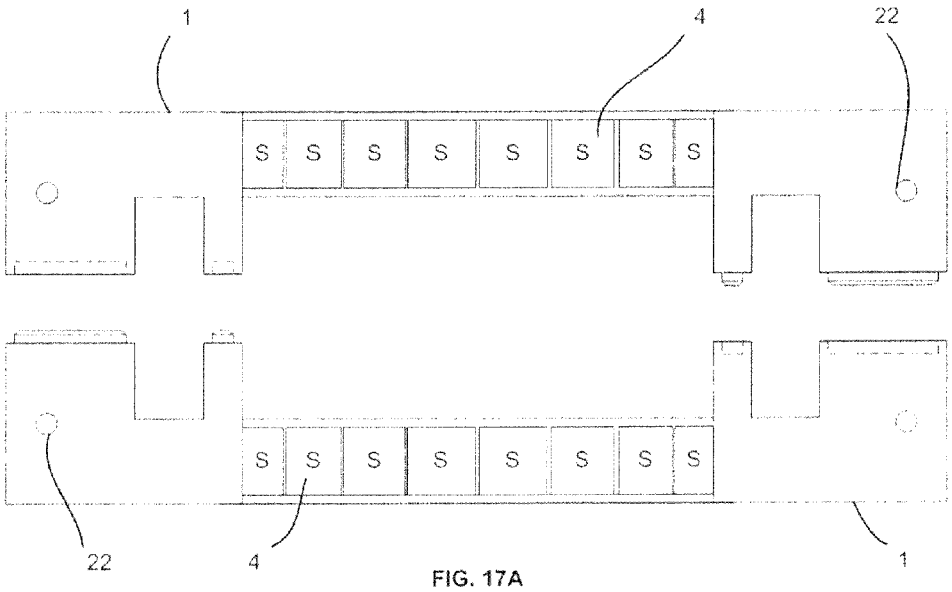
FIG. 17A shows the rear external view of the upper and lower magnet support structures and magnets of the device of FIG. 12A.
Figure 17B:
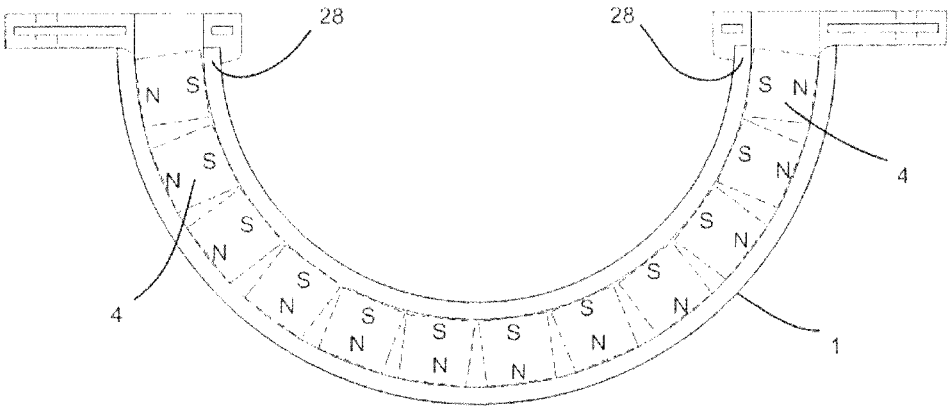
FIG. 17B shows the top-view of the lower support structure of FIG. 17A, with the location of the internal magnets as shown by the dotted lines.

The completed diaphragm stack 5 of FIG. 20A, is a self-supporting structure which can then be placed in the magnetic field of the 180-degree alternative embodiment of FIG. 11A by first inserting the lower end of the inner pole piece 7 shown in FIGS. 14A&B and FIG. 12A into the guide channels 28 of the lower magnet support structure 1 as shown in FIG. 16B and FIG. 17B, then inserting the magnets 4 into the holes in the lower magnet support structure 1 as shown in FIG. 16B and FIG. 17B, allowing the south poles of the magnets to be attracted toward the center pole piece 7, and taking care to align the north and south poles of the magnets 4 as shown in FIGS. 16A&B and FIGS. 17A&B.

The completed diaphragm stack 5 can then be slid down over the inner pole piece 7. The upper magnet support structure 1 shown in FIG. 16A and FIG. 17A can then be slid down over the inner pole piece 7, using the smooth, flat, upward and downward-facing surfaces shown in FIG. 16A and FIG. 17A to form an air-tight seal between the front and rear surfaces of the diaphragm stack 5 of FIG. 20A.

Figure 14B:
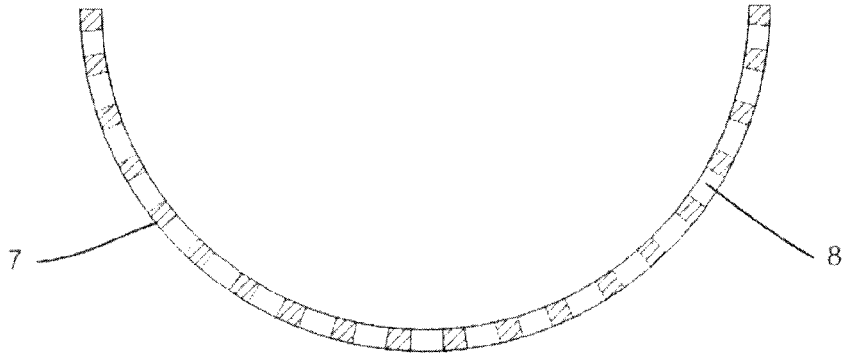
FIG. 14B shows the horizontal cross-section of FIG. 14A, with the view line as shown in FIG. 14A.
Figure 15A:
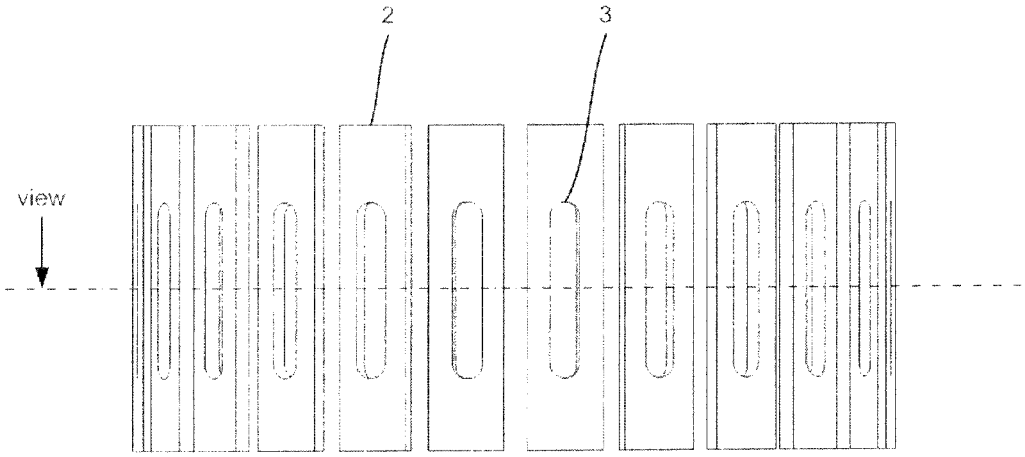
FIG. 15A shows the external front view of the outer pole pieces of the device of FIG. 12A.
Figure 15B:
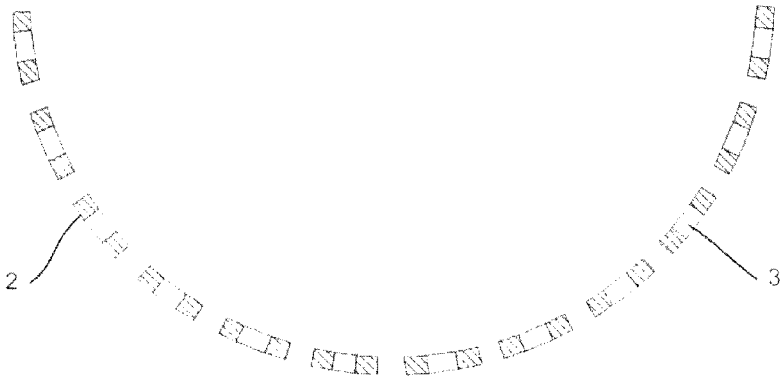
FIG. 15B shows the horizontal cross-section of FIG. 15A, with the view line as shown in FIG. 15A.

In addition, the short extensions 24 on the inner and outer support/sealing rings 16 and 15 respectively of FIG. 14B and FIG. 15B, also help to form an air-tight seal between the front and rear surfaces of the diaphragm stack 5 of FIG. 20A.

Magnets 4 can then be inserted into the holes in the upper magnet support structure 1 shown in FIG. 16A and FIG. 17A, allowing the south poles of the magnets to be attracted toward the inner pole piece 7, and taking care to align the north and south poles of the magnets 4 as shown in FIGS. 16A&B and FIGS. 17A&B.

The outer pole pieces 2 shown in FIG. 11A and FIGS. 15A&B can then be placed onto the exposed north poles of the magnets 4 of both the upper and lower magnet support structures 1 shown in FIGS. 11A&B and FIG. 13A, using magnetic attraction to keep the outer pole pieces 2 in place, as well as using any appropriate additional fixing means, generally known to those skilled in the art, that might be necessary.

Figure 12B:
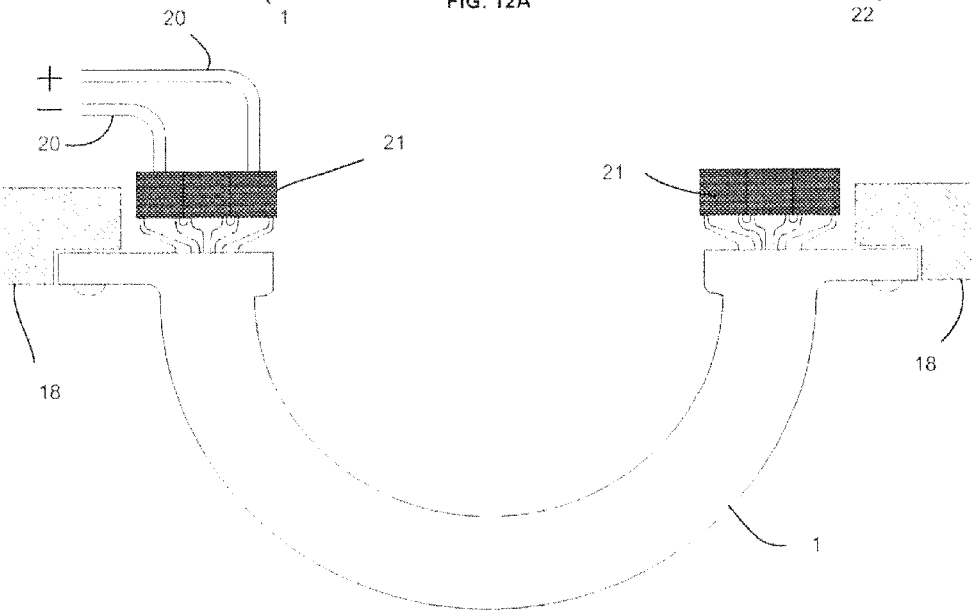
FIG. 12B shows the external bottom-view of a semi-circular embodiment of the device.

As shown in FIG. 12A and FIG. 12B, the front or rear, or upper or lower, smooth surfaces of the magnet support structures 1 of the assembled alternative 180-degree embodiment shown in FIG. 11A can be left open, sealed, ported, dampened, horn-loaded or otherwise vented by any suitable means by any desired combination of ports, vents, horn flares, surfaces or other wave-guiding, sealing or dampening materials, etc., generally known to those skilled in the art.

For all of the embodiments of the present invention, the magnets 4 as shown in FIGS. 4A-C, FIGS. 16A&B, FIGS. 17A&B, and FIG. 23, can be made of any suitable permanent magnet material such as ceramic, ferrite, neodymium-iron-boron, alnico, samarium cobalt, or can be comprised of electro-magnets, or any suitable combination of permanent magnet material, magnetic flux-directing material, or electro-magnetic components, and may be shaped as cubes, rectangles, wedges, tubes, rings or any other suitable shape which results in the required magnetic field shape.

There may exist, in all embodiments of the present invention, a number of alternative means employed for directing, shielding or otherwise influencing the direction of the magnetic field flux lines within or around the device, as illustrated by FIGS. 1A&B, FIG. 11A, FIG. 13A, FIG. 14A and FIG. 23, as well as many other possible variations generally known to those skilled in the art, all of such variations falling within the scope of the spirit of the present invention.

As shown in FIGS. 2A&B, FIGS. 3A&B, FIGS. 14A&B and FIGS. 15A&B, the inner and outer pole pieces 2 and 7 for all embodiments can be made of steel or any other suitable material with the proper magnetic characteristics known to those skilled in the art. The outer pole pieces 2 have openings in them 3 which allow for sound waves to pass through, while also concentrating the magnetic field flux lines toward the diaphragm stack 5. Likewise, the inner pole pieces 7 have openings 8 in them to allow for sound waves to pass through, and can also concentrate the magnetic flux lines toward the diaphragm stack 5.

As an alternative embodiment, such as that shown in FIG. 23, the device may also be constructed without the use of inner or outer pole pieces if desired, in some instances using magnetic flux-return plates 26 made of steel or any other appropriate material or configuration generally known to those skilled in the art, to help direct an appropriate amount of magnetic flux through the diaphragm stack 5.

As shown in FIG. 5, FIG. 20B, FIG. 10 and FIG. 21, the electric conductors 13 for all embodiments can be made of any suitable electrically conductive material such as metal, conductive plastic, carbon-based materials, conductive paint, or aluminum foil which has been bonded onto any suitable diaphragm substrate material such as polyimide, polyethylene naphthalate, Mylar, etc., which are generally known to those skilled in the art.

The electrically conductive elements 13 can be sized in thickness, width, location and quantity in order to provide any needed electrical impedance and electro-motive force, as generally known to those skilled in the art.

Figure 11B:
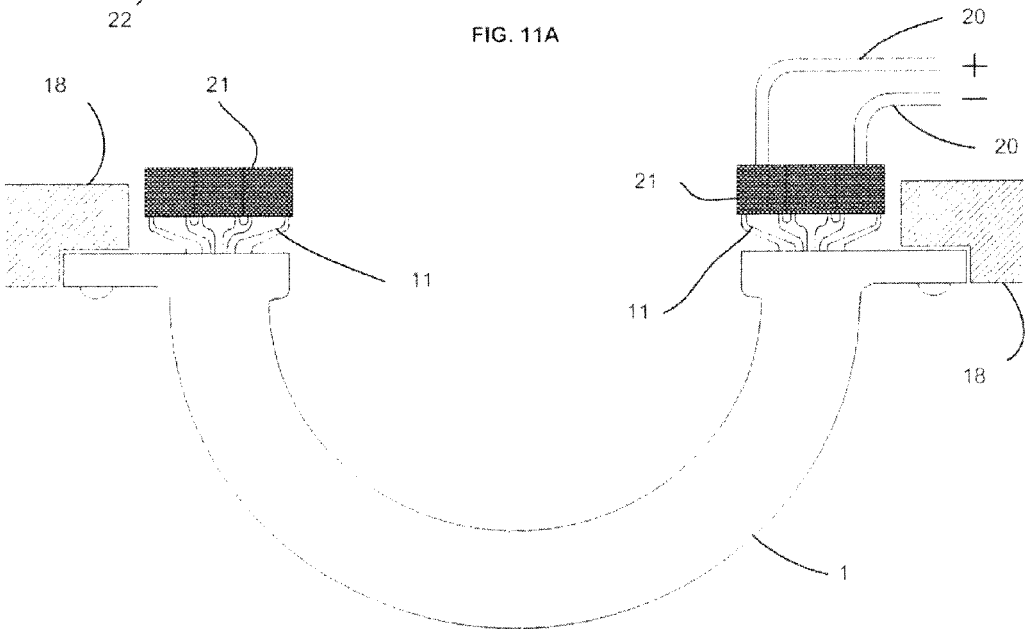
FIG. 11B shows the external top-view of a semi-circular embodiment of the device.

The electrically conductive elements 13 may be terminated by any of the means generally known to those skilled in the art, to provide for an appropriate electrical and mechanical connection, such as the lead wires 20 and electrical connectors 21 as shown in FIG. 11B and in FIG. 12B. Alternatively, the diaphragm layer substrate material may also be itself made of a conductive material.

As shown in FIG. 4A-C, FIGS. 16A&B and FIGS. 17A&B, the magnet support structures 1 for all embodiments can be made of any suitable, relatively rigid material such as plastic, metal, ceramic, wood, carbon-based materials or any other suitable material, and can be attached to the magnets 4 and/or pole pieces 2 and 7 with adhesives, screws, magnetic attraction or through any other suitable means.

As shown in the exploded, conceptual view of FIG. 8, FIG. 9A and FIG. 20A the small pieces of alignment material 17, which are spaced apart from each other and placed between the diaphragm layers 10, can be made of a wide variety of either rigid or flexible materials, such as plastic foam tape, for example, for all embodiments.

In addition to being constructed with diaphragm layers 10 and electric conductors 13 shaped in a circular or any other overall loop shape, and also in the alternative embodiment semi-circular shape of FIGS. 11A&B, the device can also be constructed with an overall arc-shaped section of any arbitrary angle of less than 360 degrees.

The resulting arc-shaped device can be mounted in an appropriate baffle 18 using the screw holes 22 shown in FIGS. 11A&B and FIGS. 12A&B. The baffle 18 may also be part of an enclosed, vented, ported or partially open cabinet or other structure such as an in-wall mounted device or an open-rear baffle device, all generally known to those skilled in the art. The front or rear of the resulting arc-shaped device may also be horn-loaded as well.

Figure 22:
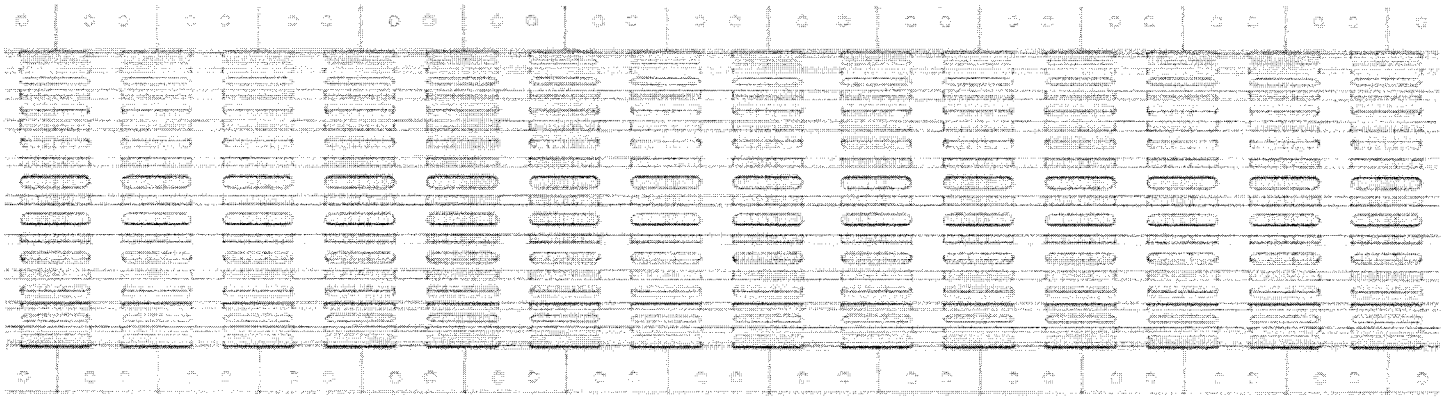
FIG. 22 shows a partial section of a vertical stack of alternating sections of diaphragm stacks and magnet sections of a semi-circular embodiment of the device.

As shown by FIG. 22, a stacked, "line-source" version of the driver can be built, exhibiting extremely high efficiency, extremely wide frequency range, extremely wide horizontal dispersion, extremely uniform frequency coverage in the vertical direction, and extremely high maximum power handling.

The "stacked" loudspeaker embodiment as shown in FIG. 22 may consist of a plurality of either the closed-loop configured embodiments as shown by FIG. 1A, or may consist of a plurality of arc-segment configured embodiments as shown in FIG. 11A, which can then be electrically connected in series, parallel, or a number of possible series/parallel combinations to achieve the desired total electrical impedance.

Figure 24A:
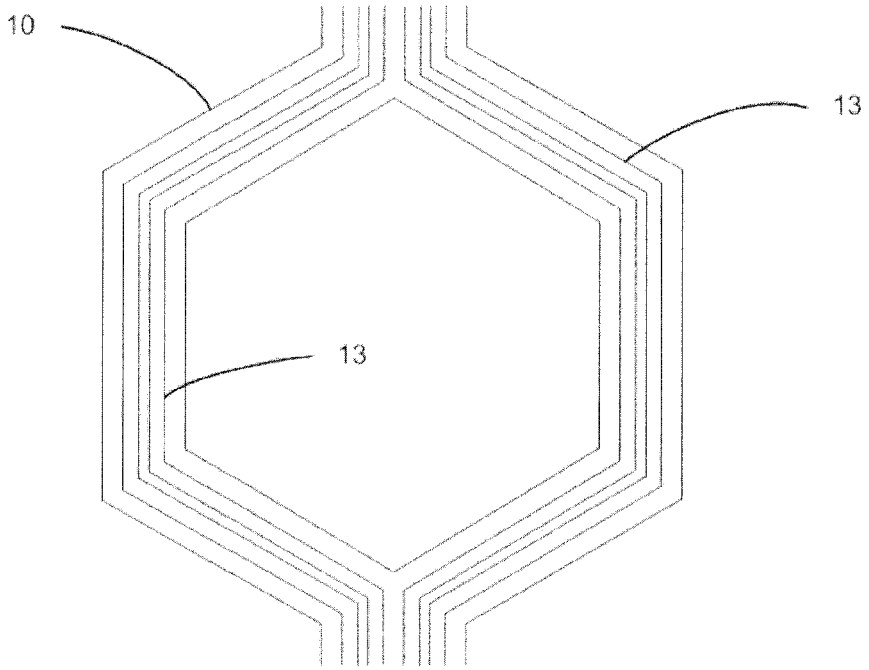
FIG. 24A shows an external top-view of an alternative, closed-loop diaphragm layer shape.
Figure 24B:
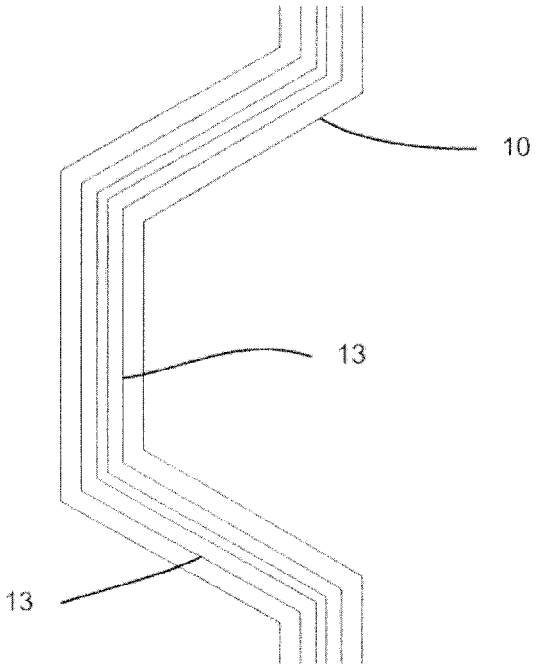
FIG. 24B shows an external top-view of an alternative, arc-shaped diaphragm layer section shape.

In addition to the continuously-curved diaphragm layers and electrical conductors of the present invention previously discussed herein, it is also possible to configure the device in discretely-curved types of configurations, such as those shown in FIGS. 24A&B, in which there exist one or more discrete areas of curvature of the diaphragm layers 10. These discreetly-curved areas will cumulatively accomplish an overall curvature of the diaphragm stack 5, with an axis of curvature 29 which is generally perpendicular to the diaphragm surface and/or electric conductors at the point, or points, of curvature.

The foregoing description of embodiments has been presented for purposes of illustration and description. It is not exhaustive, and it does not limit the claimed inventions to the exact forms disclosed. Additional modifications and variations are possible, in light of the above description, or may be acquired from development of the invention.

What is claimed is:

1. An air motion transformer loudspeaker driver comprising: a plurality of planar, moving diaphragm layers, the diaphragm layers being folded or stacked to from a diaphragm stack, the diaphragm layers each comprising a convexly curved outer edge, a concavely curved inner edge and one or more electric conductors positioned between the inner and outer edges, the electric conductors each having a non-linear geometric configuration before the diaphragm layers are folded or stacked to form the diaphragm stack, the diaphragm layers each comprising at least one preformed moving section located between the outer edge and the inner edge and at least one non-moving section located between the outer edge and the inner edge, the preformed moving sections each having a non-linear geometric configuration.

2. An air motion transformer loudspeaker driver as recited in claim 1, wherein the electric conductors are each located on or in each of the moving diaphragm layers, wherein the electric conductors each follow a non-straight path.

3. An air motion transformer loudspeaker driver as recited in claim 1, wherein the moving planar surfaces provide each of the diaphragm layers with a continuous, closed loop shape.

4. An air motion transformer loudspeaker driver as recited in claim 3, wherein the closed loop shape is a circle.

5. An air motion transformer loudspeaker driver as recited in claim 3, wherein the closed loop shape is a polygon.

6. A loudspeaker driver comprising a plurality of diaphragm layers, the diaphragm layers each comprising a convexly curved outer edge, a concavely curved inner edge and at least one electric conductor positioned between the inner and outer edges, the electric conductors each comprising a preformed moving section having a non-linear configuration located between the inner and outer edges and a non-moving section located between the inner and outer edges.

7. A loudspeaker driver as recited in claim 6, wherein the moving sections are each preformed to include an arc-shaped segment.

8. A loudspeaker driver as recited in claim 6, wherein the moving sections are each preformed to follow a non-straight path.

9. A loudspeaker driver as recited in claim 6, wherein the electric conductors each include a plurality of concentric conductor traces.

10. A loudspeaker driver as recited in claim 6, wherein each of the diaphragm layers is connected to an adjacent one of the diaphragm layers by one or more of the electric conductors.

11. A loudspeaker driver as recited in claim 6, wherein the outer and inner edges each have an axis of curvature that is generally perpendicular to a planar surface of a respective one of the diaphragm layers at a location of the outer edge and a location of the inner edge, the electric conductors each being positioned on or in the planar surfaces.

12. A loudspeaker driver as recited in claim 6, wherein the diaphragm layers form a diaphragm stack such that the diaphragm layers are generally parallel to one another.

13. A loudspeaker driver as recited in claim 6, wherein the one or more electric conductors each comprise concentric conductor traces and the diaphragm layers form a diaphragm stack such that the concentric conductor traces of one of the diaphragm layers are coaxial with the concentric conductor traces of an adjacent one of the diaphragm layers.

14. A loudspeaker driver as recited in claim 6, wherein the diaphragm layers form a diaphragm stack that is positioned over an inner pole piece such that inner diaphragm leads of each of the diaphragm layers are aligned with a slot in the inner pole piece.

15. A loudspeaker driver as recited in claim 6, wherein the diaphragm layers include a plurality of adjacent diaphragm layers and the loudspeaker driver further comprises a curved support member placed between each of the adjacent diaphragm layers and small pieces of alignment material positioned between two of the support members.

16. A loudspeaker driver as recited in claim 6, wherein the diaphragm layers each include a moving surface such that adjacent diaphragm layers move toward one another or away from one another upon application of varying voltage and current.

17. A loudspeaker driver as recited in claim 6, wherein the diaphragm layers form a diaphragm stack, the loudspeaker driver comprising at least one magnet section located proximate the stack such that the at least one magnet section produce a magnetic field comprising a radial component at a location of the electric conductors that intersects a direction of current flow in each of the electric conductors at right angles to the radial component of the magnetic field in order to provide electromotive force to move adjacent ones of the diaphragm layers toward one another or away from one another upon application of varying voltage and current.

18. An air motion transformer loudspeaker driver comprising a plurality of diaphragm layers, the diaphragm layers each comprising a convexly curved outer edge, a concavely curved inner edge and one or more electric conductors positioned between the inner and outer edges, the electric conductors each comprising a preformed moving section having a polygonal configuration located between the inner and outer edges and a non-moving section located between the inner and outer edges.

19. An air motion transformer loudspeaker driver as recited in claim 18, wherein the polygonal configuration is a hexagonal configuration.

20. An air motion transformer loudspeaker driver as recited in claim 18, wherein the polygonal configurations each comprise a first section extending along a first axis and a second section extending from the first section along a second axis, the second axis extending at an acute angle relative to the first axis.

21. An air motion transformer loudspeaker driver as recited in claim 18, wherein each of the diaphragm layers is connected to an adjacent one of the diaphragm layers by at least one of the electric conductors.

22. An air motion transformer loudspeaker driver as recited in claim 18, wherein the diaphragm layers include a plurality of adjacent diaphragm layers and the loudspeaker driver further comprises a curved support member placed between each of the adjacent diaphragm layers and small pieces of alignment material positioned between two of the support members.

23. An air motion transformer loudspeaker driver as recited in claim 18, wherein the diaphragm layers form a diaphragm stack, the loudspeaker driver comprising at least one magnet section located proximate one end of the stack such that the magnet section or sections produce a magnetic field comprising a radial component at a location of the one or more electric conductors that intersects a direction of current flow in each of the electric conductors at right angles to the radial component of the magnetic field to provide electromotive force to move adjacent ones of the diaphragm layers toward one another or away from one another upon application of varying voltage and current.

* * * * *